US005566771A

United States Patent [19]

Wolfer et al.

[11] Patent Number: 5,566,771

[45] Date of Patent: Oct. 22, 1996

[54] REVERSIBLE CASING FOR A SELF-LUBRICATING, FLUID-ACTUATED, PERCUSSIVE DOWN-THE-HOLE DRILL

[75] Inventors: Dale R. Wolfer, Salem; Leland H. Lyon, Roanoke, both of Va.

[73] Assignee: Ingersoll-Rand Company, Woodcliff Lake, N.J.

[21] Appl. No.: 520,799

[22] Filed: Aug. 30, 1995

[51] Int. Cl.[6] ..... E21B 4/14

[52] U.S. Cl. ..... 175/296; 175/215; 173/135

[58] Field of Search ..... 175/296, 215, 175/293, 100; 173/135, 17, 16, 131

[56] References Cited

U.S. PATENT DOCUMENTS

| | | | |
|---|---|---|---|
| 3,941,196 | 3/1976 | Curington et al. | 175/100 |
| 4,084,646 | 4/1978 | Kurt | 173/17 |
| 4,321,974 | 3/1982 | Klemm | 175/92 |
| 4,660,658 | 4/1987 | Gustafsson | 175/296 |
| 4,819,746 | 4/1989 | Brown et al. | 175/296 |
| 5,311,948 | 5/1994 | Kimberlin | 173/17 |
| 5,390,749 | 2/1995 | Lyon | 175/296 |

*Primary Examiner*—Frank Tsay
*Attorney, Agent, or Firm*—John J. Selko

[57] ABSTRACT

A reversible casing for a fluid-actuated, percussive, down-the-hole drill is provided with a tubular body having an internal surface forming a bore extending along a longitudinal axis. The internal surface has a profile that is a mirror image about a centerline axis perpendicular to the longitudinal axis. The profile is provided with alternating undercut portions and land portions, with a portion of the undercut portions being in an annular scalloped configuration comprising a plurality of longitudinally extending parallel grooves in the internal surface.

7 Claims, 6 Drawing Sheets

REVERSIBLE CASING FOR A SELF-LUBRICATING, FLUID-ACTUATED, PERCUSSIVE DOWN-THE-HOLE DRILL

BACKGROUND OF THE INVENTION

This invention relates generally to downhole pneumatic rock drills (DHD), and more particularly to drills that do not require oil lubrication for sliding surfaces in contact within the drill.

Downhole drills, such as those described by Kurt in U.S. Pat. No. 4,084,646 and by Fu et al in U.S. Pat. No. 5,085,284, are well known in the art. These devices all require the use of special purpose, petroleum oil lubrication to reduce wear of the relatively sliding parts and to prevent friction welding (galling), and subsequent failure of those parts. This lubricant is introduced as a mist in the operating air stream and exhausted into the bore hole (and ultimately the atmosphere) with the air exhausted from the drill. Since the used oil is not recoverable, the operator of the drill must bear considerable expense in providing lubricant for the drill. The open lubrication system may also create environmental problems by introducing oil into the air, ground, and in the some cases, groundwater. This has resulted in DHDs being prohibited in certain applications, groundwater monitoring wells, for example. It is therefore advantageous to produce a DHD which does not require oil lubrication.

DHDs made according to the prior art effect sealing of the operating chambers of the drill by means of a close fit between sliding contact surfaces of the major components of the drill. As normal wear progresses, performance of the drill deteriorates. Ultimately, some or all of the major components of the drill must be replaced to restore drill performance. Unless all worn parts are replaced, performance cannot be restored to new condition. Since the wearing parts are major components of the drill, considerable expense is incurred by such restoration. Due to the close sliding fits required in the prior art, lubrication failure or contamination introduced into the DHD frequently results in catastrophic failure of one or more major components of the drill. Such failure results in lost production, repair expense, and in warranty costs for the manufacturer. It is therefore advantageous to produce a DHD with replaceable seal and bearing elements that prevent catastrophic failure of major drill components and that can restore drill performance following normal wear.

Conventional modern valveless or semi-valveless DHDs typically supply air to the operating chambers via a system of grooves, slots and/or undercuts in the hammer casing ID, piston, or in a "control rod" disposed in the center of the DHD and slidably engaged with the piston. In these DHDs, valving of the air flow is accomplished by the interaction of the termini of these features during the progression of the piston stroke. The grooves, etc. are usually relatively wide to provide adequate flow area for supply air. The termini of these ports are relatively square to precisely define the valving sequence, known in the art as "timing points." If replaceable bearings and seals are introduced to such an arrangement, the seals and bearings will enter the groove or slot. When the seal and/or bearing encounter the terminus of a port, considerable damage to, or catastrophic failure of the seal and bearing element(s) results. It is therefore advantageous that a DHD including replaceable, self-lubricating bearings and seals be provided with a porting arrangement that prevents damage to the bearings and seals.

The foregoing illustrates limitations known to exist in present DHD's. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this alternative is accomplished by providing a casing for a self-lubricating, fluid-actuated, percussive down-the-hole drill comprising: an elongated, hollow tubular body having a first casing end and a second casing end, the body having a longitudinal axis extending therethrough; an internal surface on the body forming a bore therein, the bore being substantially circular in cross section, as viewed perpendicular to the longitudinal axis; the casing having a centerline axis perpendicular to the longitudinal axis, the centerline axis being spaced substantially equally from the first and second casing ends; the internal surface forming a profile comprising: first undercut and land means between the centerline axis and the first casing end, for supporting operative elements of a drill backhead assembly in the bore and for defining, with the operative elements, passageways for flow of percussive fluid therein; second undercut and land means between the centerline axis and the second casing end, for supporting operative elements of a drill fronthead assembly in the bore and for defining, with the operative elements, passageways for flow of percussive fluid therein; the first undercut and land means including an annular scalloped portion of the casing comprising a plurality of longitudinally extending grooves in the inner surface, the grooves being spaced parallel to each other, and each pair of grooves alternating with a longitudinally extending land surface therebetween, formed by the inner surface, whereby, when a piston is slidingly positioned adjacent to the inner surface, a self-lubricating seal member and a self-lubricating bearing member positioned on the piston can slide over the scalloped portion, to maintain contact with the inner surface, while alternately opening and closing the grooves during a cycle of drill operation.

The foregoing and other aspects will become apparent from the following detailed description of the invention when considered in conjunction with the accompanying drawing figures.

BRIEF DESCRIPTION OF THE DRAWING FIGURES

DETAILED DESCRIPTION

Figure 1:
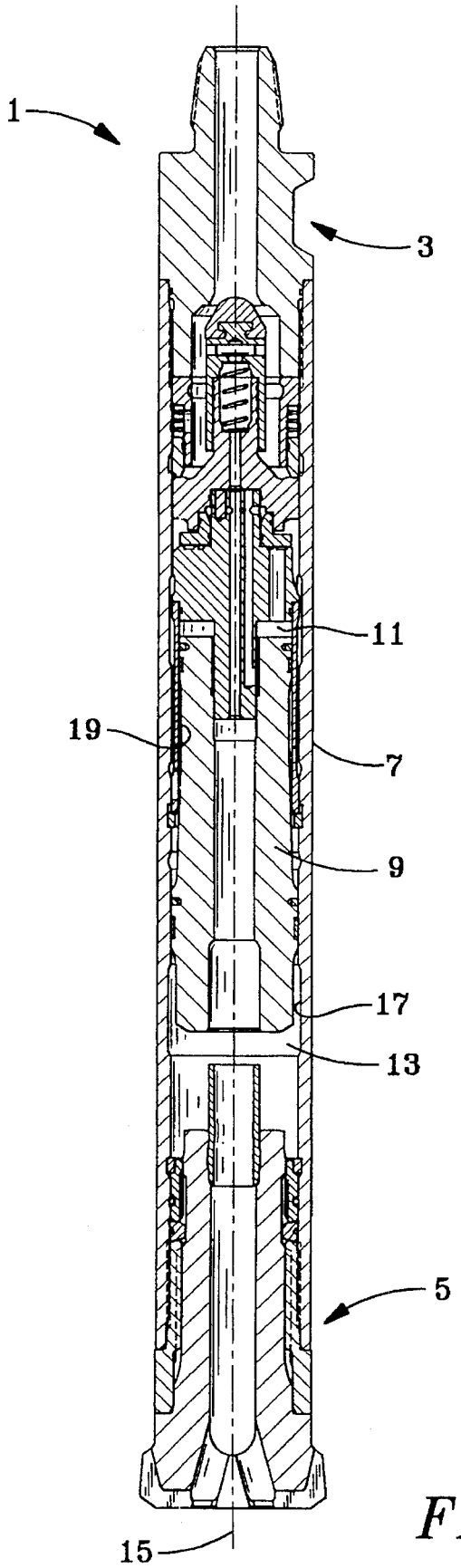
FIG. 1 is a longitudinal section of a downhole drill of the invention.

FIG. 1 shows a self-lubricating, fluid-actuated, percussive, down-the-hole drill 1 having a backhead assembly 3, a fronthead assembly 5, and a hollow, tubular casing 7 connecting backhead assembly 3 and fronthead assembly 5. A piston 9 is slidingly supported in casing 7 for reciprocating between a drive chamber 11 and a return chamber 13. Passageway means are formed in drill 1 for transmitting flow of percussive fluid therethrough to actuate piston 9, as described hereinafter. Backhead assembly 3 and fronthead assembly 5 are aligned with each other along a longitudinal axis 15. Piston 9 is slidingly supported against an inner surface 17 of casing 7 and against an inner surface 19 of backhead assembly 3 for reciprocation between drive chamber 11 and return chamber 13.

Figure 9:
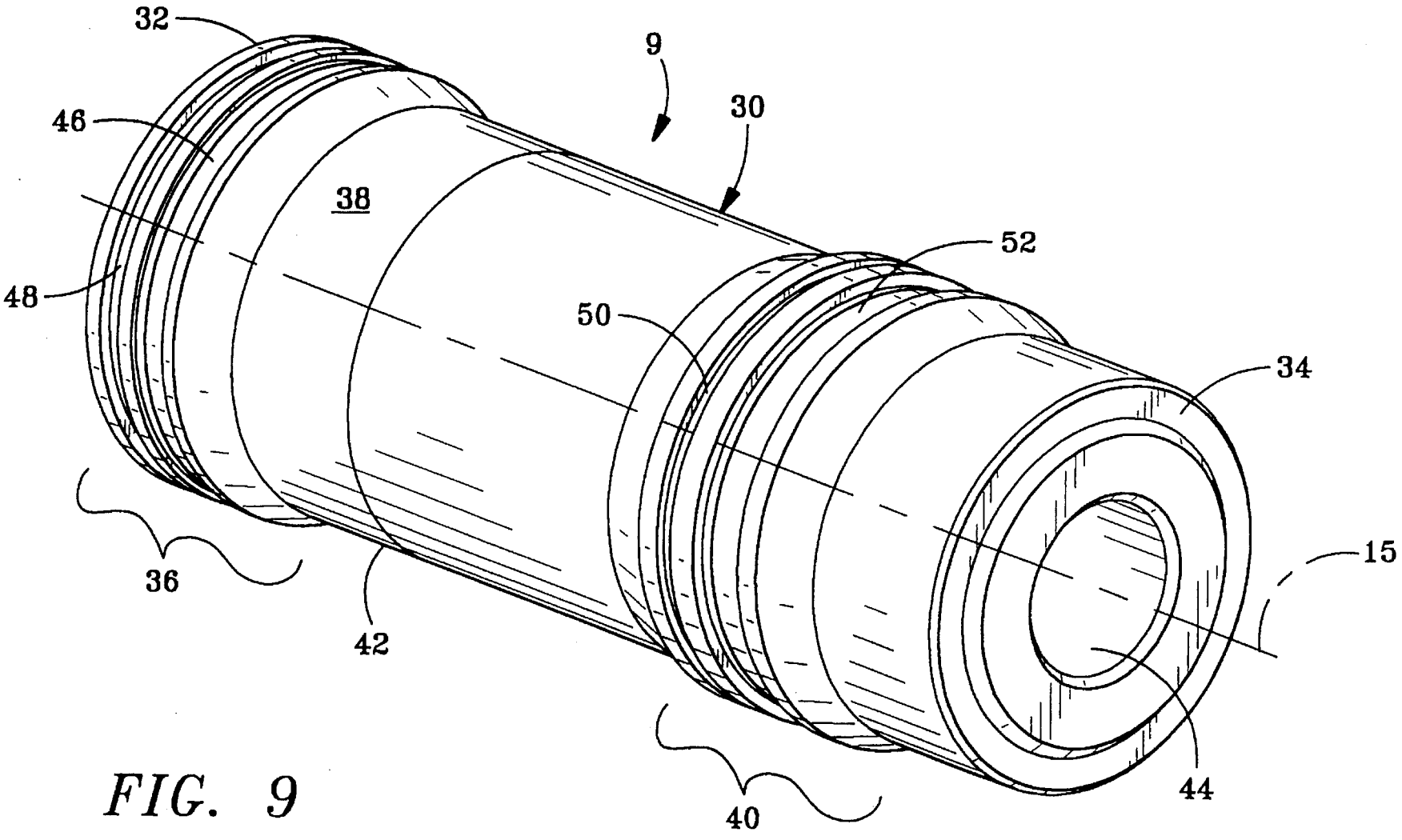
FIG. 9 is an isometric view of a piston according to the invention.

Referring to FIG. 9, the piston 9 will be further described. Piston 9 includes an elongated body member 30 terminating in back end 32 and front end 34. Body member 30 has a generally circular cross section, as viewed radially to longitudinal axis 15. A first land portion 36 is positioned on outer surface 38 adjacent to back end 32. A second land portion 40 is positioned on outer surface 38 adjacent front end 34. An undercut portion 42 extends between first land portion 36 and second land portion 40. Bore 44 extends longitudinally through body member 30 along axis 15. As used herein the term "bore" refers to a bore generally circular in cross section, as viewed perpendicular to axis 15.

First land portion 36 is supplied with annular grooves 46, 48 extending circumferentially around body 30. Second land portion 40 is supplied with annular grooves 50, 52 extending circumferentially around body 30. Grooves 46, 48, 50, and 52 are parallel to each other and are in planes substantially perpendicular to axis 15. Grooves 46, 50 receive a removable, self-lubricating seal member 54 (FIG. 4) and grooves 48, 52 receive a removable, self-lubricating bearing member 56 (FIG. 4), as described hereinafter.

Figure 2:
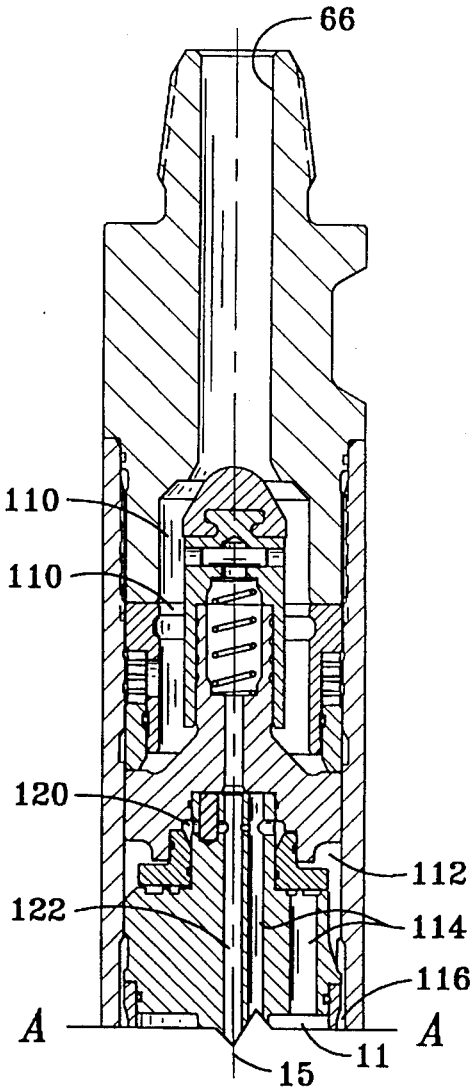
FIG. 2 is longitudinal section of an upper portion of a downhole according to the invention, with the piston in a drive position.
Figure 5:
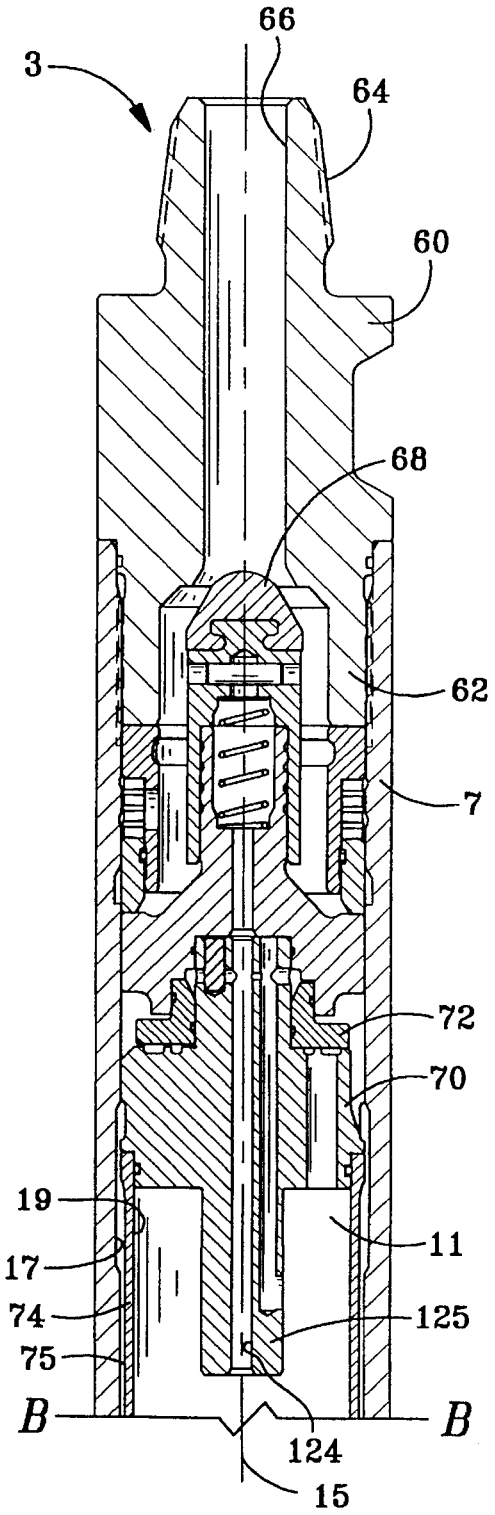
FIG. 5 is a view similar to FIG. 1, with the piston in a position out of contact with the drill bit.
Figure 7:
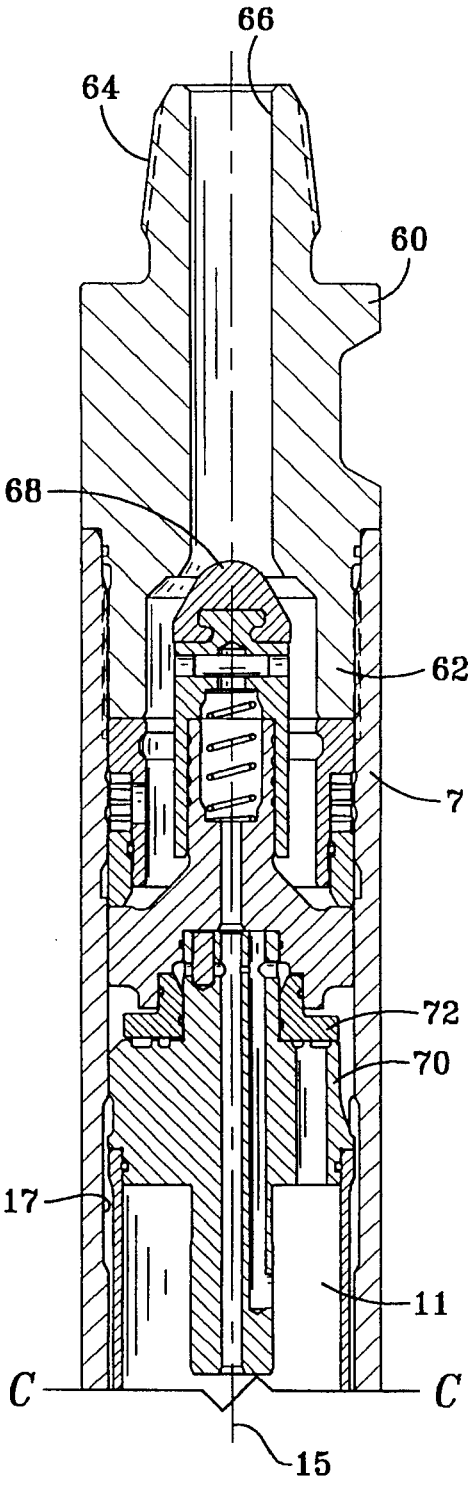
FIG. 7 is a view similar to FIG. 2, with the piston in a return position.

As shown in FIGS. 2, 5 and 7, the backhead assembly 3 comprises a backhead member 60 having a first end 62 removably connected to casing 7, and a second end 64 adapted for removably affixing to a drill string (not shown), as is well known. Bore 66 extends longitudinally through backhead assembly along axis 15. Check valve means 68 is positioned in casing 7 for selectively starting and stopping flow of percussive fluid in bore 66, as is well known. Air distributor means 70 is positioned in casing 7 adjacent to check valve means 68. Air distributor means 70 includes a pressure sensitive valve 72 for selectively directing percussive fluid to drive chamber 11 and return chamber 13 during a cycle of piston 9. Valve 72 is of the type described in U.S. Pat. No. 5,301,761 to Chen-Cheng Fu et al. A hollow, tubular cylinder 74 is positioned in casing 7 adjacent air distributor means 70 and supported on stop ring 71. Outer surface 75 of cylinder 74 is spaced from inner surface 17 of casing 7. Air distributor means 70, cylinder 74 and back end 32 of piston 9 are adapted to selectively-open and close drive chamber 11 during a cycle of piston 9, as described hereinafter.

Figure 3:
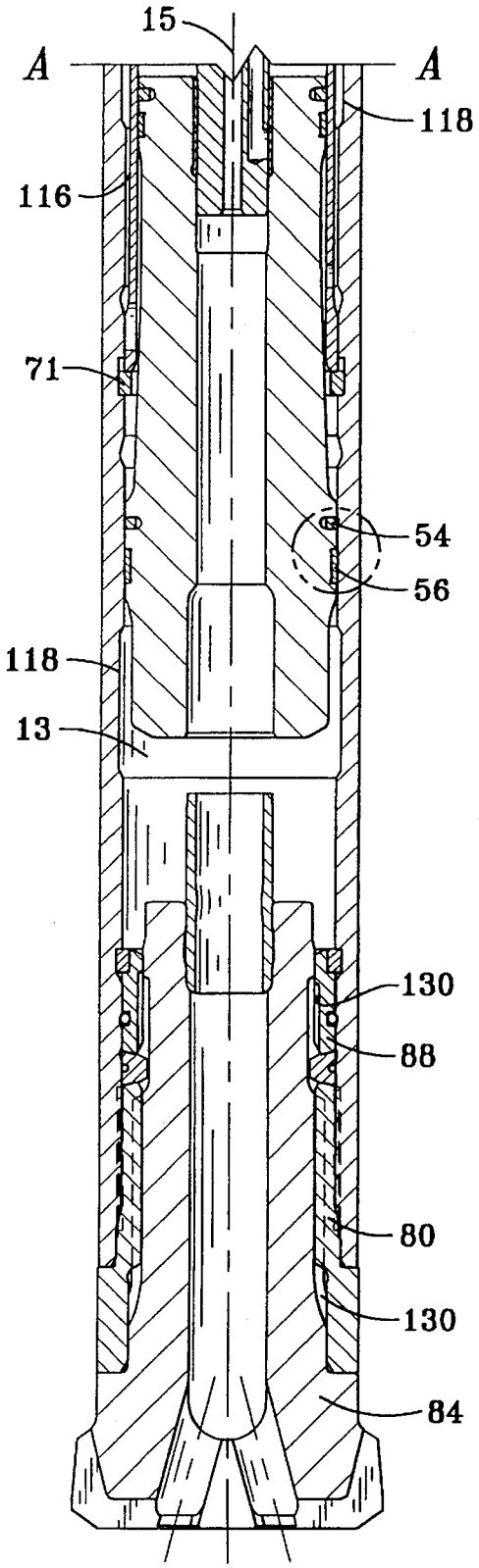
FIG. 3 is longitudinal section of a lower portion of a downhole drill according to the invention, showing the piston in a drive position.
Figure 6:
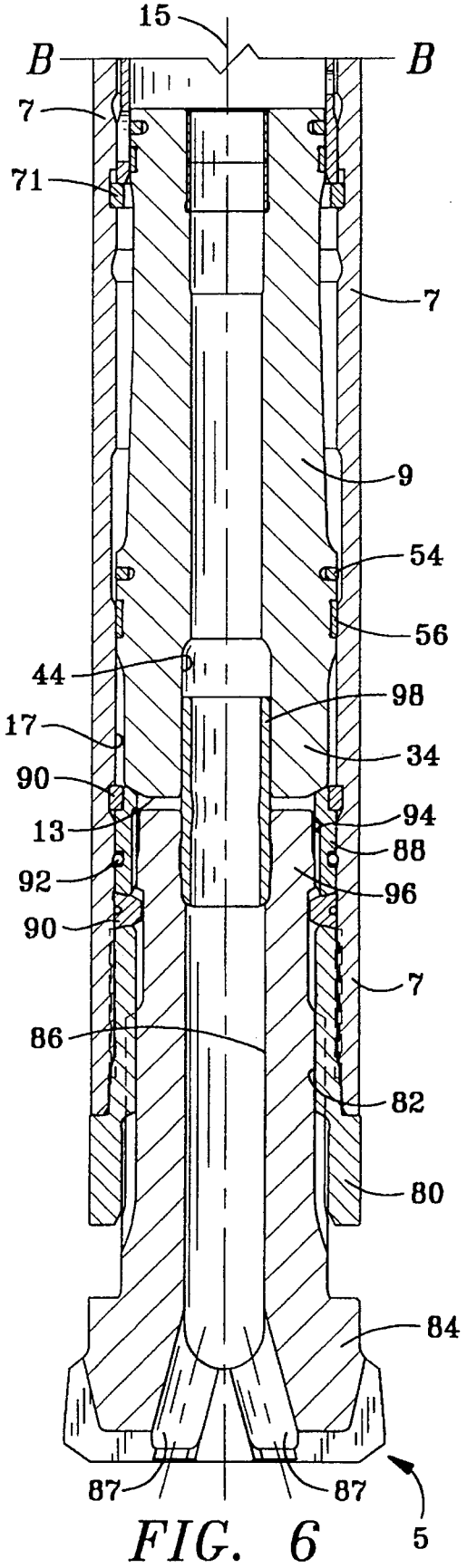
FIG. 6 is a view similar to FIG. 3, showing the piston in a position known as "off bottom"
Figure 8:
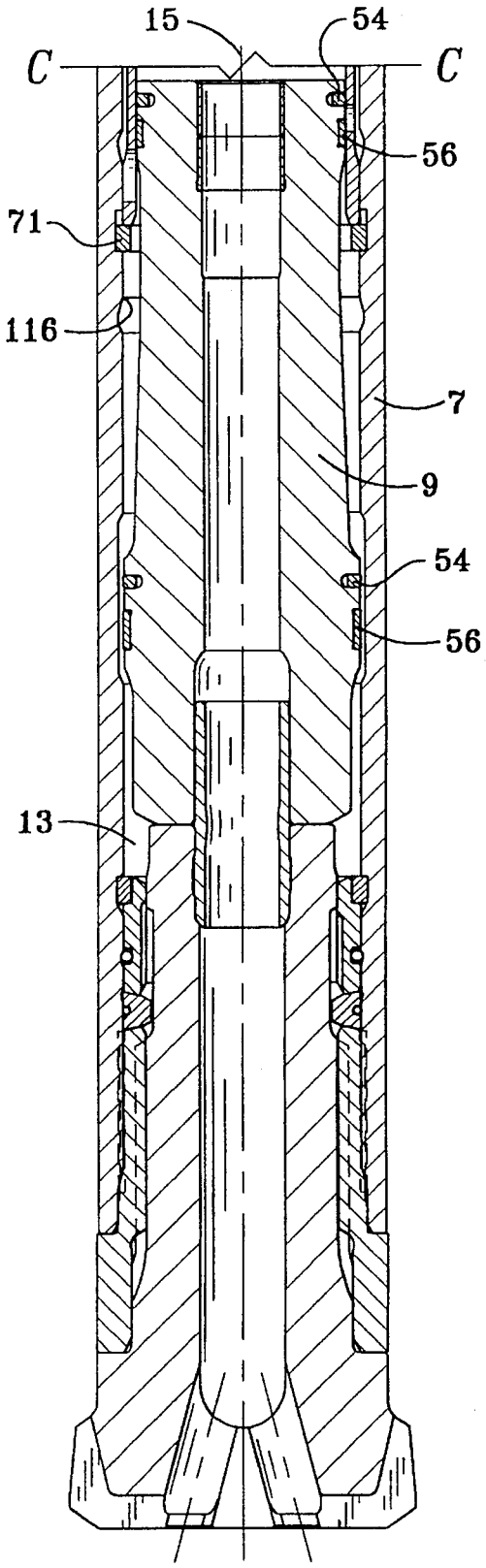
FIG. 8 is a view similar to FIG. 3, showing the piston in a return position.

Referring to FIGS. 3, 6 and 8, fronthead assembly 5 will be further described. Fronthead assembly 5 includes chuck 80, removably connected to casing 7, as is will known. Bore 82 extends therethrough along axis 15. Drill bit 84 is removably retained in chuck 80. Bit 84 has bore 86 therethrough along axis 15 and opening into apertures 87. Drill bit bearing 88 is positioned in casing 7 below front end 34 of piston 9 and above chuck 80, using stop ring 90 and retainer 92. Bearing 88 has a bore 94 therethrough along axis 15 for receiving and supporting a back end 96 of bit 84, as is well known. Inner surface 17 of casing 7 and front end 34 of piston 9 are adapted to selectively open and close return chamber 13 during a cycle of piston 9, when piston bore 44 seals and unseals over tube 98 positioned in bit bore 86, as is well known.

Figure 4:
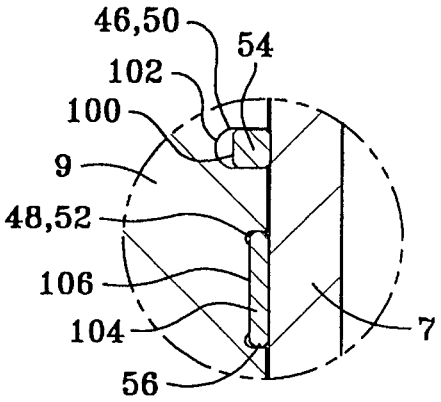
FIG. 4 is an expanded view of the circled portion of FIG. 3.

Now referring to FIG. 4, the self-lubricating seals 54 and bearings 56 will be further described. Seals 54 and bearings 56 are in the form of annular split rings that can be opened to be placed into their respective grooves, 46, 50 and 48, 52, respectively, on piston 9. Seals 54 are mounted such that the inside diameter 100 of seals 54 does not contact root 102 of grooves 46, 50. This arrangement allows seals 54 to "float" in grooves 46, 50, thereby maximizing sealing effectiveness. The seals 54 so mounted are energized to "float" by line percussive pressure via communication with passageways in drill 1. The term "float" is used herein to mean that seals 54 have a limited movement in a radial, axial and circumferential direction in grooves 45, 50. Since the seal's position is not fixed in relation to piston 9, seals 54 are incapable of performing a load bearing function. Therefore, bearings 56 are positioned near the ends of each land 36, 40, adjacent seals 54. Bearings 56 are fit into grooves 48, 52 such that there is direct contact between the bearing inside diameter 104 and the bottom 106 of grooves 48, 52, as well as between the bearings 56 and oppositely spaced, parallel sidewalls of grooves 48, 52. This arrangement prevents substantial movement of bearings 56 radially or axially in grooves 48, 52 but permits a slight amount of such movement. In addition, circumferential movement in grooves 48, 52 is permitted. Thus, bearings 56 are sufficiently fixed in position to contact their corresponding surface in drill 1 to support piston 9 therein. The grooves 48, 52 have a depth such that any bearing therein will not have its outer surface positioned below the outer surface of piston 9.

We have discovered that the sealing function and bearing function cannot be suitably supplied by a single element. A single element designed to "float" in its groove cannot sufficiently guide the piston 9 to maintain alignment. Conversely, a single element fixed in its groove quickly looses its ability to seal effectively due to wear. By separating the sealing and bearing functions, we can provide optimum function in each. We prefer that self-lubricating seals 54 and bearings 56 be made from a monocast nylon material supplied by the Polymer corporation under the product designation "MC901".

Now referring to FIGS. 2, 5 and 7, the backhead passageways will be described. Percussive fluid from drill string (not shown) enters bore 66, passed through accumulator chamber 110, around check valve 68 to air distributor 70 via passageway portion 112. As valve 72 opens and closes, passageway 114 to drive chamber 11 are opened and closed. A casing passageway 116 extends between casing 7 and piston 9 (FIGS. 2, 3) to return chamber 13. A portion of the casing passageway 116 is formed by undercuts 118 on the internal surface of casing 7, as described hereinafter.

A longitudinal axis passageway is formed by passageways 120, 122 into bore 124 of air distributor stem 125 extending along axis 15. Bore 124 communicates with bore 44 of piston 9 and bore 86 of bit 84. The longitudinal axis passageway also passes through drive chamber 11 and return chamber 13, when such chambers are uncovered by piston 9.

A fronthead passageway 130 is formed by the combination of inner surface 132 of bit bearing 88 (FIG. 3) and bit 84, when bit 84 is in bearing 88. Fronthead passageway 130 extends along bit 84, in bore 86, between chuck 80 and bit 84.

Figure 10:
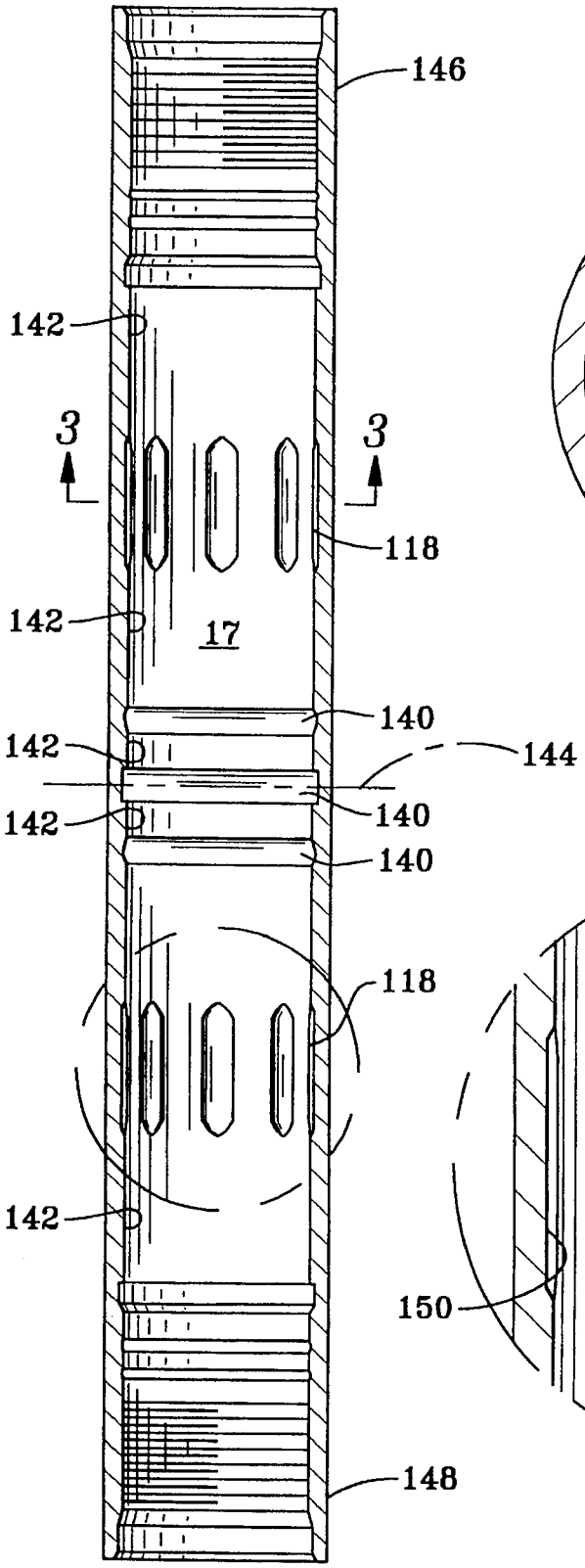
FIG. 10 is a longitudinal section of a casing according to the invention.
Figure 12:
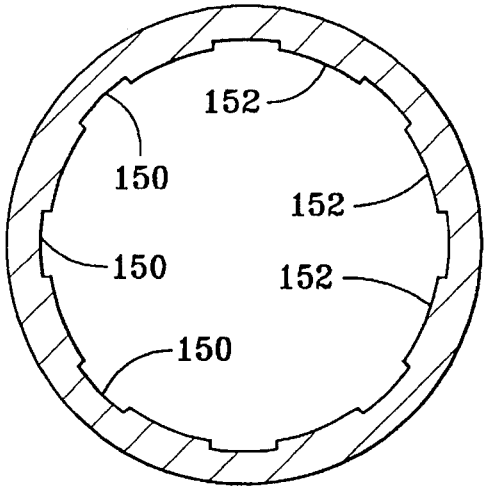
FIG. 12 is a view along 3—3 of FIG. 11.
Figure 11:
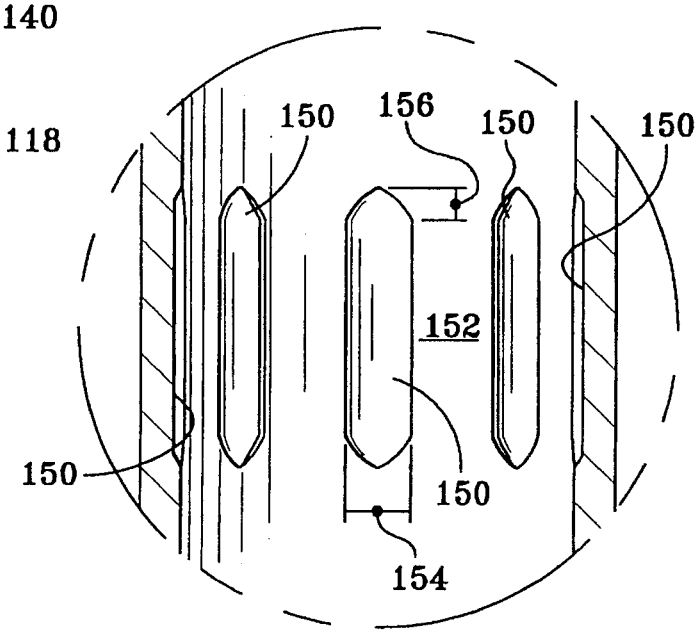
FIG. 11 is an expanded view of the circled portion of FIG. 10.

Now referring to FIGS. 10–12, casing 7 will be further described. Internal surface 17 of casing 7 has a profile that is provided by a plurality of undercut portions 118 and 140 alternating with land portions 142. The profile combines with the surfaces of grooves and undercuts in piston 9, the backhead assembly 3 and the front head assembly 5 to form fluid passageways in drill 1. The exact combination of undercuts 140 and lands 142 in casing 7 and the grooves and undercuts in the other elements may vary from drill to drill, except that the undercuts 118 are required for this invention, as described hereinafter.

A centerline axis 144 is shown perpendicular to longitudinal axis 15. Centerline axis 144 is spaced equally from first and second ends 146,148 of casing 7. We prefer to make casing 7 reversible lengthwise, so that it can be reversed if one end of casing 7 wears during use. In order for casing 7 to be reversible, first undercut and land means (114, 118, 142) between centerline axis 144 and first end 146 must be a substantial mirror image of second undercut and land means (114, 118, 142) between centerline axis 144 and second end 148, as measured about centerline axis 144. Slight variations away from mirror image will work, so long as the fluid passageways function the same regardless of lengthwise orientation of the casing 7. Alternately, the casing can be non-reversible by providing non-mirror image relationship between the undercut and land means on either side of centerline axis 144.

Undercuts 118 are required in the fronthead assembly for the self-lubricating seals 54 and bearings 56 described herein. As seen in FIGS. 3, 6 and 8, seal 54 and bearing 56 pass over undercut portion 118 during a piston cycle. If undercut 118 were a full annular groove in surface 17, seal 54 and bearing 56 would lose contact with surface 17 during this cycle. However, seal and bearing contact is maintained by providing undercut 118 as an annular "scalloped" portion in casing 7, with one such scalloped portion positioned on either side of centerline axis 144, as shown in FIGS. 10–12. Each scalloped portion, undercut 118, is a plurality of longitudinally extending grooves 150 in surface 17 interrupted by land portions 152 over which seal 54 and bearing 56 ride during the cycle. We have also discovered an unexpected requirement for the dimensions of the grooves 150 to provide optimum performance and long life of seals 54 and bearing 56. Grooves 150 are sized such that the chord length 154 of each groove, measured at the ID of casing 7 is between 2 and 10 percent, and preferably about 5 percent, of the circumference of the bore of casing 7. Further, the sum of the chord lengths 154 of all grooves in a scalloped portion is not more than 50 percent of the bore circumference. Each groove 150 has a first and second end tapered to form a general "V" shape, so as to provide gradual change of contact between grooves 150 and seal 54 and bearing 56. This arrangement minimizes the likelihood that terminal ends of split ring seal 54 and bearing 56 will extend into grooves 150 during the cycle, as a result of the dynamics of motion and pressure in drill 1. The taper length 156 is between 0.2 and 1.5 times chord length 154, preferably about 0.5 times chord length 154.

In use, the sliding surfaces are contacted by the self-lubricating seals 54 and bearings 56, avoiding metal-to-metal contact between major moving parts of the drill 1. The lack of direct contact prevents galling and the resultant damage to major drill parts. The self-lubricating properties of the seal and bearing material fulfills the low friction requirement for proper drill operation. The need for fluid lubrication is minimized or eliminated. The injection of a small amount (½ to 1½ gallons per minute) of water into the fluid stream is preferred for cooling the drill.

As seals 54 wear, pressure energization maintains effective sealing contact between the seal 54 and its cooperating part. If seals 54 and/or bearings 56 wear to the extent that drill performance is deteriorated, the worn parts are simply replaced, without the need for special tools or fixtures. Since essentially all of the wear occurs on the seals 54 and bearings 56, the drill is returned to "new" performance levels when these components are replaced.

Several alternate embodiments of the inventions herein may be considered without departing from them:

(1) Self lubricating elements can be added to the bore 44 of piston 9 and, or air distributor stem 115.

(2) Seals 54 and bearing 56 can be installed in inner surface 17 of casing 7 and/or inner surface 19 of cylinder 74.

(3) Anywhere bearings and seals slide against land areas, self-lubricating members as described herein can be installed.

Having described the invention, what is claimed is:

1. A casing for a self-lubricating, fluid-actuated, percussive down-the-hole drill comprising:

(a) an elongated, hollow tubular body having a first casing end and a second casing end, said body having a longitudinal axis extending therethrough;

(b) an internal surface on said body forming a bore therein, said bore being substantially circular in cross section, as viewed perpendicular to said longitudinal axis;

(c) said casing having a centerline axis perpendicular to said longitudinal axis, said centerline axis being spaced substantially equally from said first and second casing ends;

(d) said internal surface forming a profile comprising:

(i) first undercut and land means between said centerline axis and said first casing end, for supporting operative elements of a drill backhead assembly in said bore and for defining, with said operative elements, passageways for flow of percussive fluid therein;

(ii) second undercut and land means between said centerline axis and said second casing end, for supporting operative elements of a drill fronthead assembly in said bore and for defining, with said operative elements, passageways for flow of percussive fluid therein;

(e) said first undercut and land means including an annular scalloped portion of said casing comprising a plurality of longitudinally extending grooves in said inner surface, said grooves being spaced parallel to each other, and each pair of grooves alternating with a longitudinally extending land surface therebetween, formed by said inner surface; and (f) whereby, when a piston is slidingly positioned adjacent to said inner surface, a self-lubricating seal member and a self-lubricating bearing member positioned on said piston can slide over said scalloped portion, to maintain contact with said inner surface, while alternately opening and closing said grooves during a cycle of drill operation.

2. The casing of claim 1 further comprising: said second undercut and land means including an annular scalloped portion comprising a plurality of longitudinally extending grooves in said inner surface, said grooves being spaced parallel to each other, and each pair of grooves alternating with a longitudinally extending land surface therebetween, formed by said inner surface.

3. The casing of claim 2 wherein said first undercut and land means is the mirror image of said second undercut and land means, as viewed around said centerline axis, whereby said casing is capable of being reversed lengthwise when one end thereof becomes abraded during use.

4. The casing of claim 3 wherein each groove has a chord length, as measured on an ID of said casing, said chord length being between 2 and 10 percent of a circumference of said casing bore.

5. The casing of claim 4 wherein a sum of all chord lengths of all said grooves in a scalloped portion is not more than 50 percent of said bore circumference.

6. The casing of claim 6 wherein each groove has a groove width and a first and second end, said first and second ends being tapered into a general "V" shape.

7. The casing of claim 7 wherein a length of each said tapered first and second ends is between 0.2 and 1.5 times said groove width.

* * * * *